US008534794B1

(12) United States Patent
Snyder et al.

(10) Patent No.: US 8,534,794 B1
(45) Date of Patent: Sep. 17, 2013

(54) INK RECIRCULATION SYSTEM HAVING A POROUS PAD

(71) Applicant: Xerox Corporation, Norwalk, CT (US)

(72) Inventors: Trevor J. Snyder, Newberg, OR (US); Nicholas Hill, Portland, OR (US); Isaac S. Frazier, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/649,450

(22) Filed: Oct. 11, 2012

(51) Int. Cl.
*B41J 2/165* (2006.01)

(52) U.S. Cl.
USPC ..... 347/31

(58) Field of Classification Search
None
See application file for complete search history.

(56) References Cited

U.S. PATENT DOCUMENTS

| | | | | |
|---|---|---|---|---|
| 5,706,038 | A | 1/1998 | Jackson et al. | |
| 6,017,110 | A | 1/2000 | Jackson | |
| 6,290,324 | B1 | 9/2001 | Jackson et al. | |
| 6,527,363 | B1 | 3/2003 | Bowling et al. | |
| 6,695,429 | B2 | 2/2004 | Barinaga | |
| 7,011,399 | B2 * | 3/2006 | Godil et al. | 347/88 |
| 8,123,332 | B2 | 2/2012 | Morgan et al. | |
| 8,172,360 | B2 | 5/2012 | Tay et al. | |
| 2009/0244170 | A1 * | 10/2009 | Mikashima | 347/31 |
| 2010/0245462 | A1 * | 9/2010 | Seino et al. | 347/28 |

* cited by examiner

*Primary Examiner* — Matthew Luu
*Assistant Examiner* — Alejandro Valencia
(74) *Attorney, Agent, or Firm* — Maginot, Moore & Beck, LLP

(57) ABSTRACT

An ink recirculation assembly for an inkjet printer recovers purged ink for recycling. The ink recirculation assembly includes a porous pad configured to absorb ink from a printhead face by capillary action. The porous pad is operatively connected to an actuator, which is configured to move the porous pad to contact the printhead face to absorb ink from the printhead face. The actuator is further configured to move the porous pad to contact a heated member, which releases ink from the porous pad and enables the ink to flow into an ink receptacle for recycle or disposal.

19 Claims, 9 Drawing Sheets

INK RECIRCULATION SYSTEM HAVING A POROUS PAD

TECHNICAL FIELD

This disclosure relates generally to systems that supply and recover fluid from a device, and more particularly, to an inkjet printer configured to recover liquid ink from an inkjet printhead.

BACKGROUND

Fluid transport systems are well known and used in a number of applications. One specific application of transporting a fluid in a machine is the transportation of ink in a printer. Common examples of inks include aqueous inks and phase change or solid inks. Aqueous inks remain in a liquid form when stored prior to being used in imaging operations. Solid ink or phase change inks typically have a solid form, such as pellets or as ink sticks, which are inserted into feed channels in a printer through openings to the channels. After the ink sticks are fed into the printer, the ink sticks are urged by gravity or a mechanical actuator to a heater assembly of the printer. The heater assembly includes a heater positioned proximate to a melt plate to heat the melt plate to a temperature that melts an ink stick contacting the melt plate. The melt plate can be oriented to drip melted ink into a reservoir and the ink stored in the reservoir continues to be heated until the ink is fed to an inkjet ejector.

Fluid couplings in the printer supply the liquid ink held in each reservoir of colored ink to one or more printheads in the inkjet printing apparatus. The liquid ink is pumped from the reservoir to a manifold in the inkjet printing apparatus. As the inkjets in the printheads eject ink onto an image receiving member, the action of the diaphragms in the inkjets pulls ink from the manifold. Various embodiments of inkjets include piezoelectric and thermal devices that are selectively activated electrical firing signals received from a controller.

Phase change ink printers often include one or more heaters that generate heat to maintain a supply of phase change ink in a liquid state in the printheads and inkjets for use during printing operations. Typically, the heaters are electrical heaters that consume electrical energy to generate the desired amount of heat. In order to reduce energy usage, phase change ink printers deactivate various components, including heaters, in the printer during a sleep mode to conserve energy. The ink held in the printheads and inkjets cools and solidifies when the heaters are deactivated.

While sleep modes enable a printer to operate with reduced electrical energy consumption, the solidification of phase change ink within the printer presents difficulties in printing high quality documents when the printer emerges from sleep mode. As phase change ink within an inkjet printing apparatus cools and solidifies, the ink contracts, allowing air into the pressure chambers and fluid conduits within the printheads. As the solidified ink heats and liquefies during a subsequent warm-up process, the air forms bubbles in the liquefied ink that can interfere with operation of the inkjets in the printhead. Additionally, during the warm-up process, both the ink and air bubbles expand due to the heat applied to the printheads. The expanding air bubbles may force some ink through the ejector nozzles, which is referred to as "drooling." The drooled ink can contaminate other nozzles in the printheads or separate from the printheads and produce errant marks on the image receiving member.

To eliminate air bubbles in the liquefied ink within the printheads and to clear contaminants from the inkjet nozzles and external face of each printhead, the inkjet printing apparatus undergoes a "purge" operation, during which pressure applied to the printheads urges the liquid ink and the air bubbles through the nozzles of the inkjets. In a purge operation, the inkjets emit a stream of ink that flows down the face of the printhead and is collected in a waste ink receptacle. The purge operation removes air bubbles from the inkjets in the printheads and other fluid conduits in the inkjet printing apparatus.

In some printing apparatus designs, a wiping operation occurs after the purge operation. In a wiping operation, a wiper blade engages the face of a printhead and moves across the printhead face. The wiper blade cleans residual ink and contaminants that remain on the face of the printhead after the purge operation. In existing printers, the purged ink and ink from a wiping operation is typically collected in a waste reservoir and is eventually discarded. In printers that enter sleep modes more often to reduce electrical energy consumption, the number of purge cycles and the corresponding amount of discarded ink increases. Thus, improvements to phase change ink printers that reduce or eliminate discarded ink produced during purge cycles are desirable.

SUMMARY

In one embodiment, a device for cleaning a printhead and collecting the ink from the printhead for recycling or disposal has been developed. The device includes a porous pad, a support member, a heated member, and a first actuator. The porous pad is fixedly attached to the support member, and the first actuator is operatively connected to the support member. The first actuator is configured to move the support member to a first position where the porous pad is proximate to a face of a printhead to enable the porous pad to absorb melted phase change ink from the face of the printhead by capillary action, and to a second position where the porous pad is pressed against the heated member to enable the heated member to release ink from the porous pad to enable the released ink to be directed to an ink receptacle.

In another embodiment, a method of operating a printer collects ink purged from an inkjet printhead for recycling or disposal. The method includes moving a porous pad to a first position to absorb melted phase change ink from a face of a printhead by capillary action, the porous pad being fixedly attached to a support member that is operatively connected to a first actuator to enable the first actuator to move the porous pad to the first position. The method further includes moving the porous pad to a second position, where the porous pad is pressed against a heated member to enable the heated member to release ink from the porous pad and to enable the released ink to be directed into an ink receptacle.

DETAILED DESCRIPTION

Figure 1:
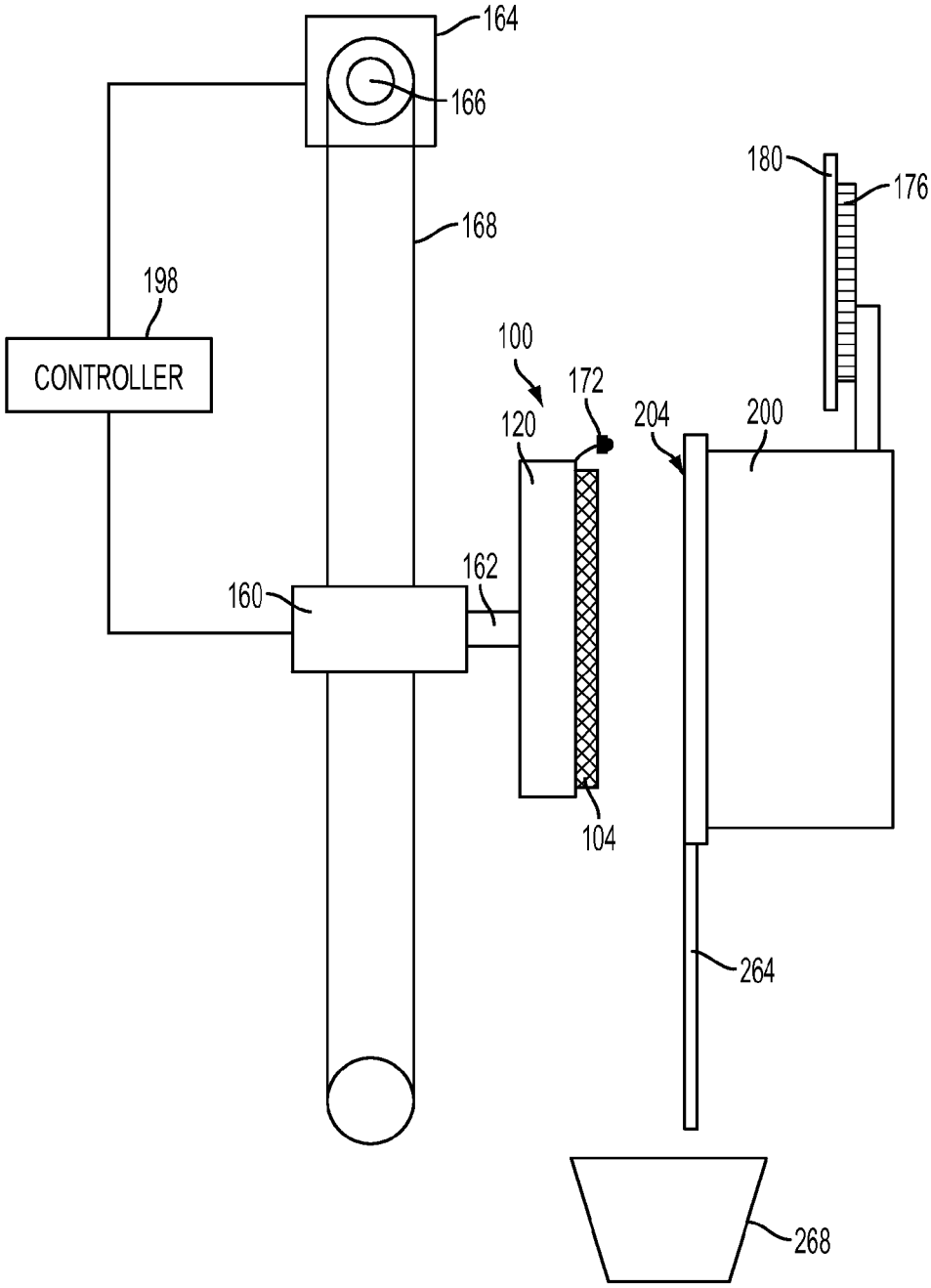
FIG. 1 is a side view of an ink collecting assembly.

For a general understanding of the environment for the system and method disclosed herein as well as the details for the system and method, reference is made to the drawings. In the drawings, like reference numerals have been used throughout to designate like elements. As used herein, a "purge" refers to a maintenance procedure performed by an inkjet printing apparatus to forcibly expel ink from the inkjet ejectors in one or more printheads in an effort to clear the inkjet ejectors. A purge can be performed by applying air pressure to an ink reservoir that is fluidly coupled to the inkjets in the printheads or by applying suction to the inkjet nozzles. A purge is typically used to remove air bubbles from conduits within the printheads or other sections of a fluid path in the inkjet printing apparatus that form each time phase change ink is melted from solid to liquid. A purge can also be performed to clear contaminants from inkjet ejectors. The term "purged ink" refers to ink expelled during a purge operation. The purged ink flows down the face of the printhead instead of being ejected toward an image receiving surface. As used herein, the terms "solid ink" and "phase change ink" both refer to inks that are substantially solid at room temperature and substantially liquid when heated to a phase change ink melting temperature for ejection from an inkjet ejector. The phase change ink melting temperature can be any temperature that is capable of melting solid phase change ink into liquid or molten form.

As used herein, the term "face" in the context of a printhead refers to a substantially planar region of a printhead that includes a plurality of inkjet nozzles. The printhead ejects ink drops through the apertures in a face plate, sometimes called "nozzles," of the printhead onto an image receiving surface during a printing operation. During a purge operation, pressure is used to eject ink through the nozzles and onto the face of the printhead.

FIG. 1 depicts an ink collecting assembly 100. The ink collecting assembly 100 includes a horizontal actuator 160, a vertical actuator 164, a support member 120, a porous pad 104, a heated plate 180, and a controller 198. The horizontal actuator 160 includes an output shaft 162, which is operatively connected to and configured to move the support member 120 in the horizontal direction to enable the porous pad 104 to move into engagement with a face 204 of a printhead 200 or to contact a heated plate 180 or a drip bib 264. The vertical actuator 164 includes an output shaft 166, which is operatively connected to a belt 168 that is attached to the horizontal actuator 160. As the vertical actuator 164 operates, the output shaft 166 rotates, moving the belt 168. The horizontal actuator 160, the support member 120, and the porous pad 104 move vertically in response to the belt 168 moving to enable the pad to contact different portions of the printhead face 204, the drip bib 264, and the heated plate 180. The horizontal 160 and vertical 164 actuators can be electric stepper motors, pneumatic actuators, or any other actuator capable of moving the ink collecting assembly 100. Although the embodiment of FIG. 1-4 uses horizontal and vertical actuators to move the ink collecting assembly, the reader should appreciate that any suitable actuation system can be used to move the ink collecting assembly to contact the printhead face, the heated plate, and the drip bib, and that the actuators need not be oriented vertically and horizontally.

Operation and control of the horizontal 160 and vertical 164 actuators of the ink collecting assembly 100 are performed with the aid of the controller 198. The controller 198 is operatively connected to the actuators 160 and 164 and is configured to generate electrical signals that activate and deactivate the actuators 160 and 164. The controller 198 can be integrated with a controller that operates the printhead 200, heater 176, and other components of the printer, or the controller 198 can be a separate controller that operates only the actuators 160 and 164. The controller can be implemented with general or specialized programmable processors that execute programmed instructions. The instructions and data required to perform the programmed functions are stored in memory associated with the processors or controllers. The processors, their memories, and interface circuitry configure the controller to perform the functions described below. These components can be provided on a printed circuit card or provided as a circuit in an application specific integrated circuit (ASIC). Each of the circuits can be implemented with a separate processor or multiple circuits can be implemented on the same processor.

The porous pad 104 is fixedly attached to the support member 120 and is configured to absorb ink from the printhead face 204 as the ink is purged from the inkjets in the face 204. Other embodiments can include more than one porous pad to enable collection of ink of different colors from the printhead face separately or to enable the ink collecting assembly to absorb greater quantities of ink. The porous pad 104 can be formed of any material suitable for wicking phase change ink from the printhead face 204, for example, a filter, cloth, or sponge material, which can be firm or flexible, is suitable for use as a pad. The pad 104 is configured to absorb at least an amount of ink ejected by the printer during a purge operation. In one embodiment the pad 104 is configured to absorb an amount of ink corresponding to at least three purge operations. In another particular embodiment, the pad is configured to absorb approximately ten grams of ink. To melt the ink absorbed in the porous pad for removal, the porous pad 104 can include an attached heater to generate thermal heat, or the pad can be heated by contact with the printhead, drip bib, and heated plate.

Figure 2:
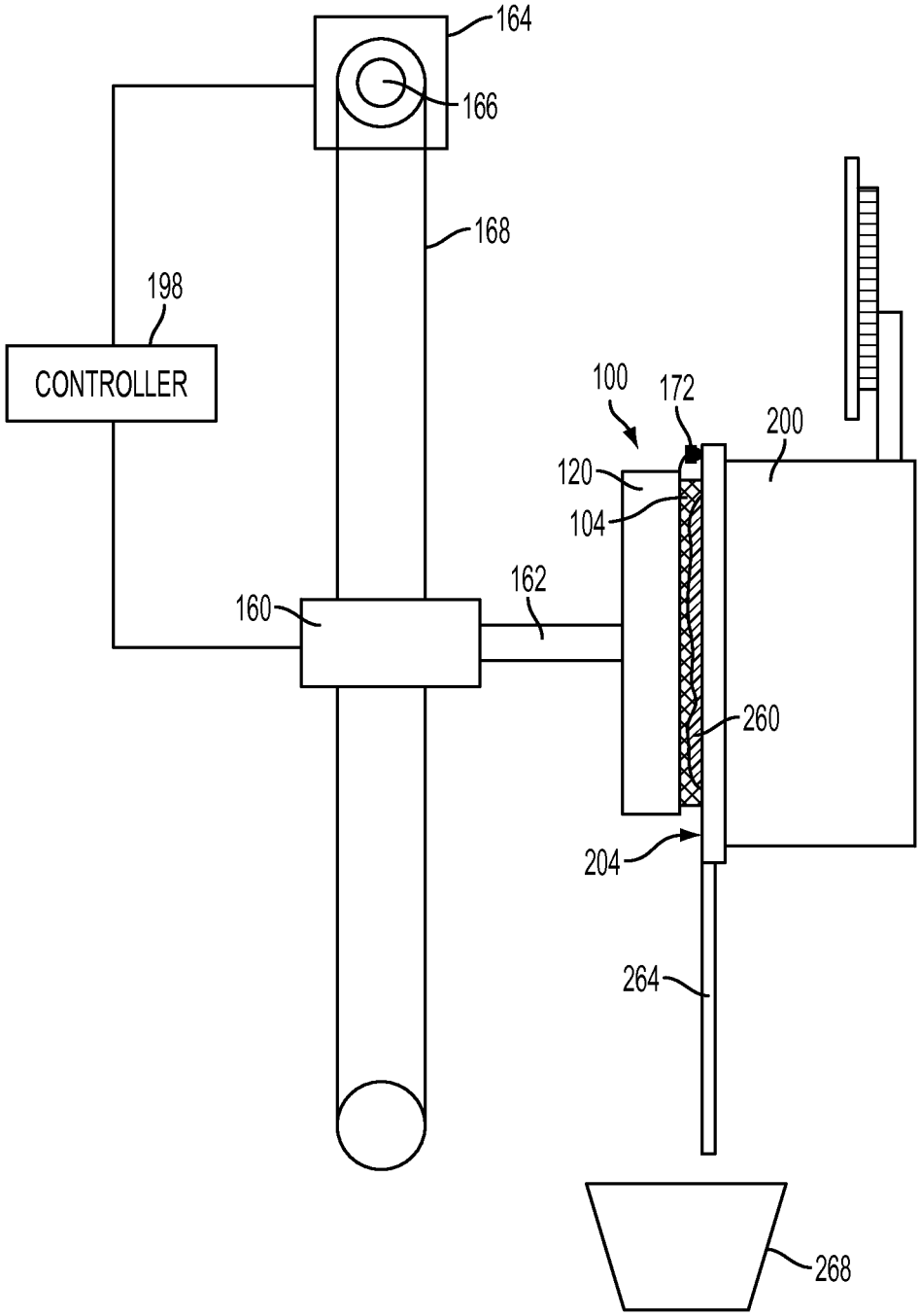
FIG. 2 is side view of the ink collecting assembly of FIG. 1 absorbing ink from a printhead face.

In operation, the controller 198 operates the vertical actuator 166 to move the ink collecting assembly 100 to position the porous pad 104 opposite the printhead face 204 as the printhead 200 prepares for a purge operation. The controller 198 activates the horizontal actuator 160 to move the support member 120 and porous pad 104 into contact with the printhead face 204, as shown in FIG. 2. The pad 104 remains in contact with the printhead face 204 as the inkjets in the printhead 204 begin purging ink. In a multi-color printhead, the inkjets in the printhead face eject ink of multiple colors, which combine to form an approximate black ink 260. The approximate black ink 260 soaks into the porous pad 104, where the ink 260 cools and solidifies. In another embodiment, the printhead ejects only one color of ink, which is absorbed by the pad for recycling or disposal. The horizontal actuator can be configured to compress the pad into the printhead face before the ink is purged. As the compressed pad is moved away from the printhead face, the decompression of the pad pulls the absorbed ink deeper into the pad, enabling the pad to absorb a larger quantity of ink from the printhead face.

The controller 198 can be further configured to operate the vertical actuator 164 to move the ink collecting assembly 100 downwardly while the porous pad 104 is in contact with the printhead face 204 to wipe the printhead face. When the porous pad 104 is moved downwardly, ink 260 remaining on the printhead face is absorbed into the pad 104 or urged downwardly onto the drip bib 264 and into the ink receptacle 268. The ink collecting assembly 100 also includes a urethane wiper 172 configured to wipe the printhead face. In the illustrated embodiment the wiper 172 is mounted on the support member 120 above the porous pad 104 and configured to wipe the printhead as the porous pad 104 wipes downwardly on the printhead face 204. The wiper 172 is attached to the support member 120 by a biasing member, for example a spring, to enable the wiper to extend beyond the porous pad 104 to enable the wiper 172 to wipe the printhead face 204 while the porous pad 104 is not in contact with the face 204. When the porous pad 104 is moved into contact with the face 204, the biasing member deforms to prevent the wiper from interfering with the operation of the porous pad 104. Alternatively, the wiper can be fixedly mounted to the support member and configured to wipe the printhead face only when the porous pad contacts the printhead face.

After the purge operation is complete, the controller 198 operates the horizontal actuator 160 to move the ink collecting assembly 100 out of contact with the printhead face 204. The controller 198 operating the ink collecting assembly 100 can be configured to wait for the next purge cycle, recycle the ink absorbed in the pad 104 back into the printhead 200, or deposit the absorbed ink 260 into the ink receptacle 268. The controller 198 of the ink collecting assembly can also be configured to recycle some or all of the ink in the pad 104 after a predetermined number of purge cycles, and to deposit the absorbed ink into the ink receptacle 268 after a second predetermined number of purge cycles.

Figure 3:
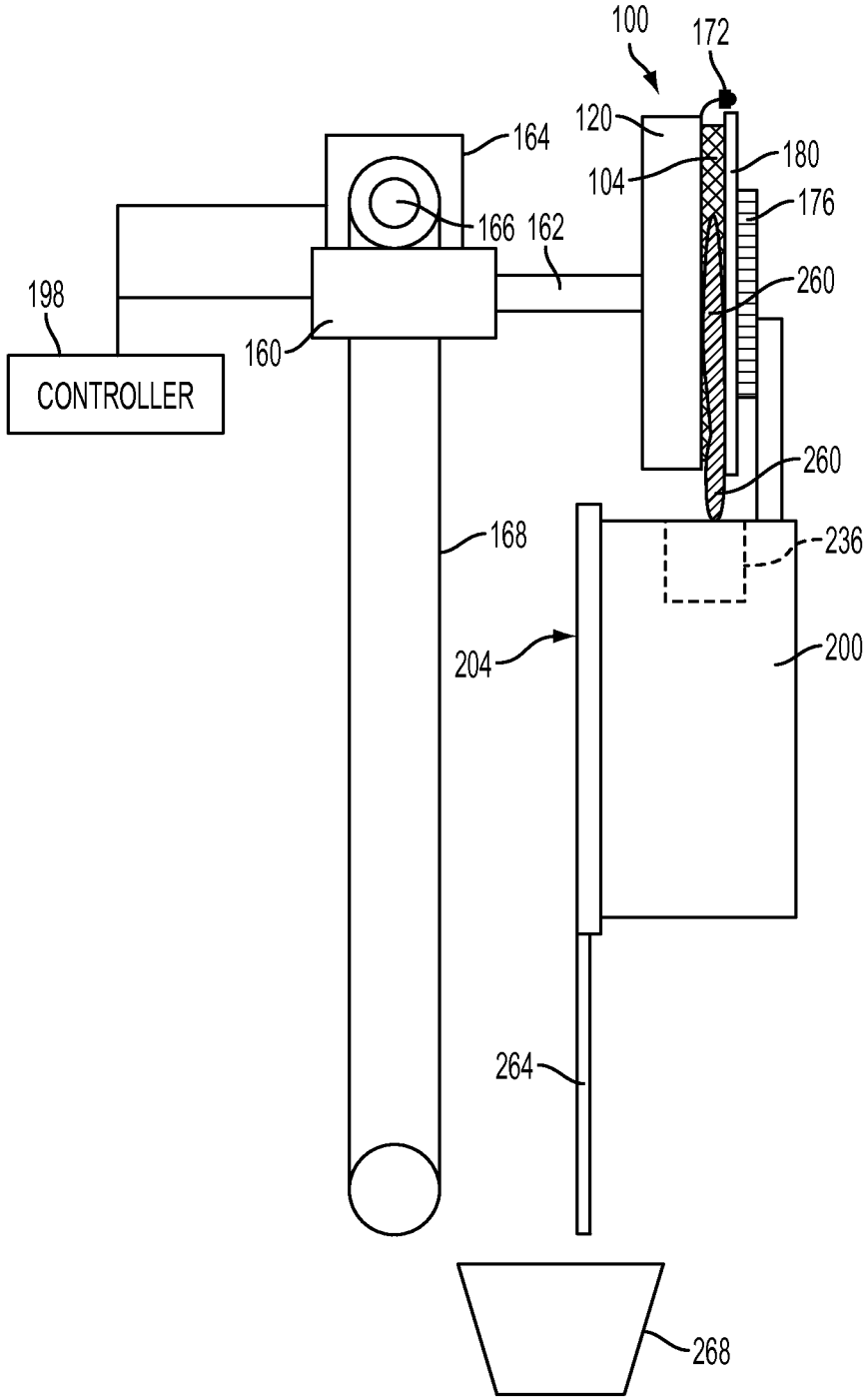
FIG. 3 is a side view of the ink collecting assembly of FIG. 1 engaged with a heated plate.
Figure 4:
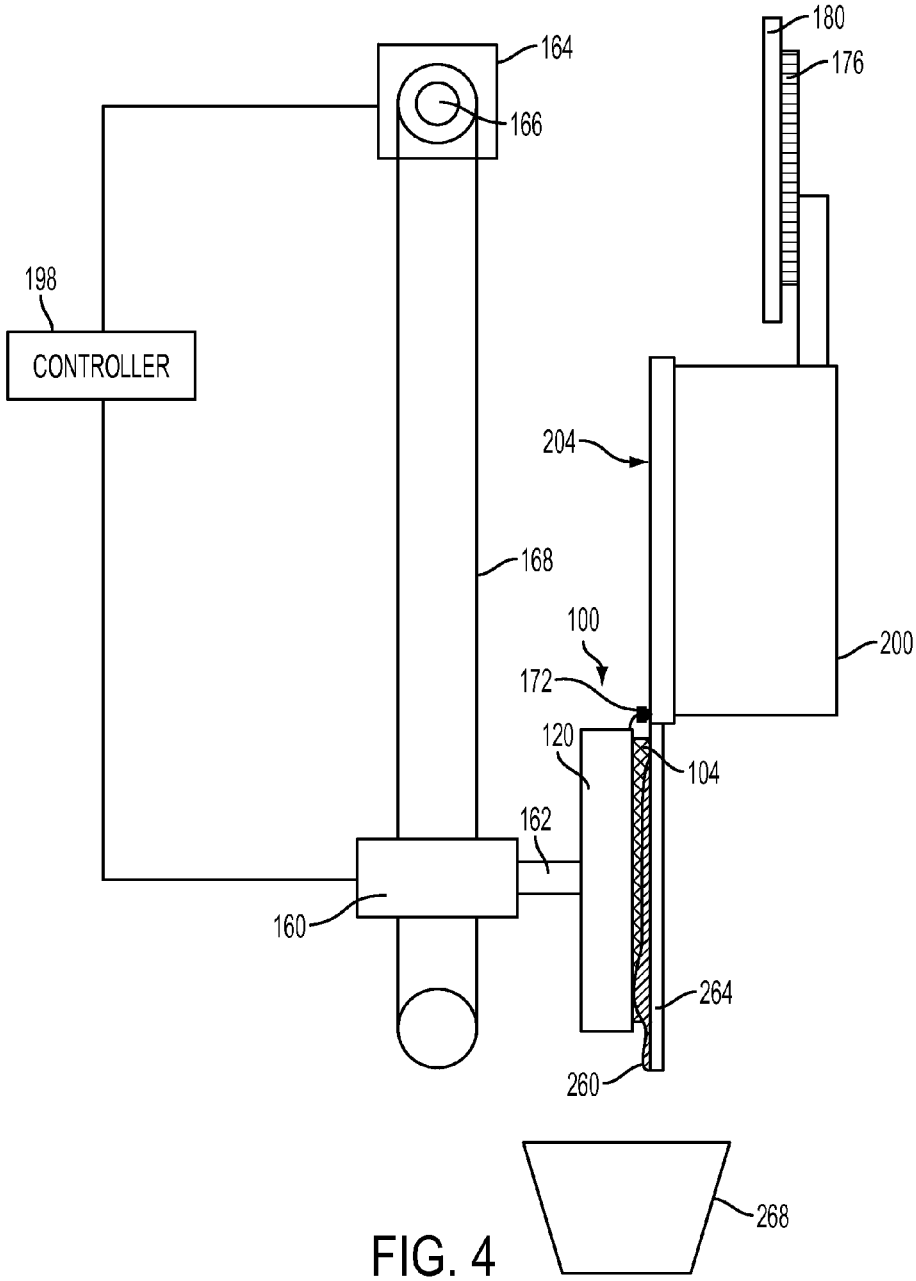
FIG. 4 is a side view of the ink collecting assembly of FIG. 1 engaged with a drip bib.

FIG. 3 illustrates the ink collecting assembly 100 positioned to recycle the ink 260 absorbed in the porous pad 104. To recycle the ink 260 absorbed in the porous pad 104, the controller 198 operates the vertical actuator 164 to rotate the output shaft 166, which moves the belt 168 and the ink collecting assembly 100 upwardly to position the porous pad 104 opposite the heated plate 180. The horizontal actuator 160 then activates to press the porous pad 104 into the heated plate 180. A heater 176 operatively connected to the heated plate 180 generates thermal heat, which heats the plate 180 and the pad 104 when the pad 104 contacts the plate 180. As the pad 104 is pressed into the heated plate 180, heat from the plate 180 melts some or all of the ink in the porous pad 104, enabling the melted ink to flow down the heated plate 180. The heated plate 180 is configured to direct the approximate black ink 260 into a reservoir 236 in the printhead 200 containing black ink. The pressure and heat applied to the porous pad 104 controls the amount of ink released from the pad 104 to flow into the black ink reservoir. In one embodiment, the porous pad 104 is configured to recycle about one gram to about two grams of approximate black ink 260 in a single recycle operation to avoid compromising the black ink quality with combined ink.

After a second predetermined number of purge cycles, the controller 198 is configured to release the ink stored in the pad 104 into the ink receptacle 268. The controller 198 operates the vertical actuator 164 to move the ink collecting assembly 100 downwardly until the porous pad 104 is positioned opposite the drip bib 264, which is mounted to the bottom of the printhead 200. The controller 198 then operates the horizontal actuator 160 to move the pad 104 into contact with the drip bib 264 as demonstrated by the position shown in FIG. 4, compressing the pad 104 against the drip bib 264. The drip bib 264 can include a heater to melt the phase change ink in the pad, or the drip bib 264 can be heated above the melting temperature of the phase change ink by the printhead 200. As the pad 104 presses into the drip bib 264, the heat from the drip bib 264 heats the pad 104, melting the approximate black ink 260 stored in the porous pad 104. The melted ink is released from the pad and flows down the drip bib 264 into the ink receptacle 268. After being collected in the ink receptacle 268, the approximate black ink 260 can be disposed of or recycled. The compression of the porous pad 104 against the drip bib 264 again controls the amount of ink released from the porous pad 104. In one embodiment, the amount of ink released from the porous pad is configured to be greater than one gram to avoid small amounts of phase change ink dripping into the ink receptacle and solidifying to form "stalagmites" in the ink receptacle, preventing the ink from filling the ink receptacle uniformly.

Figure 5:
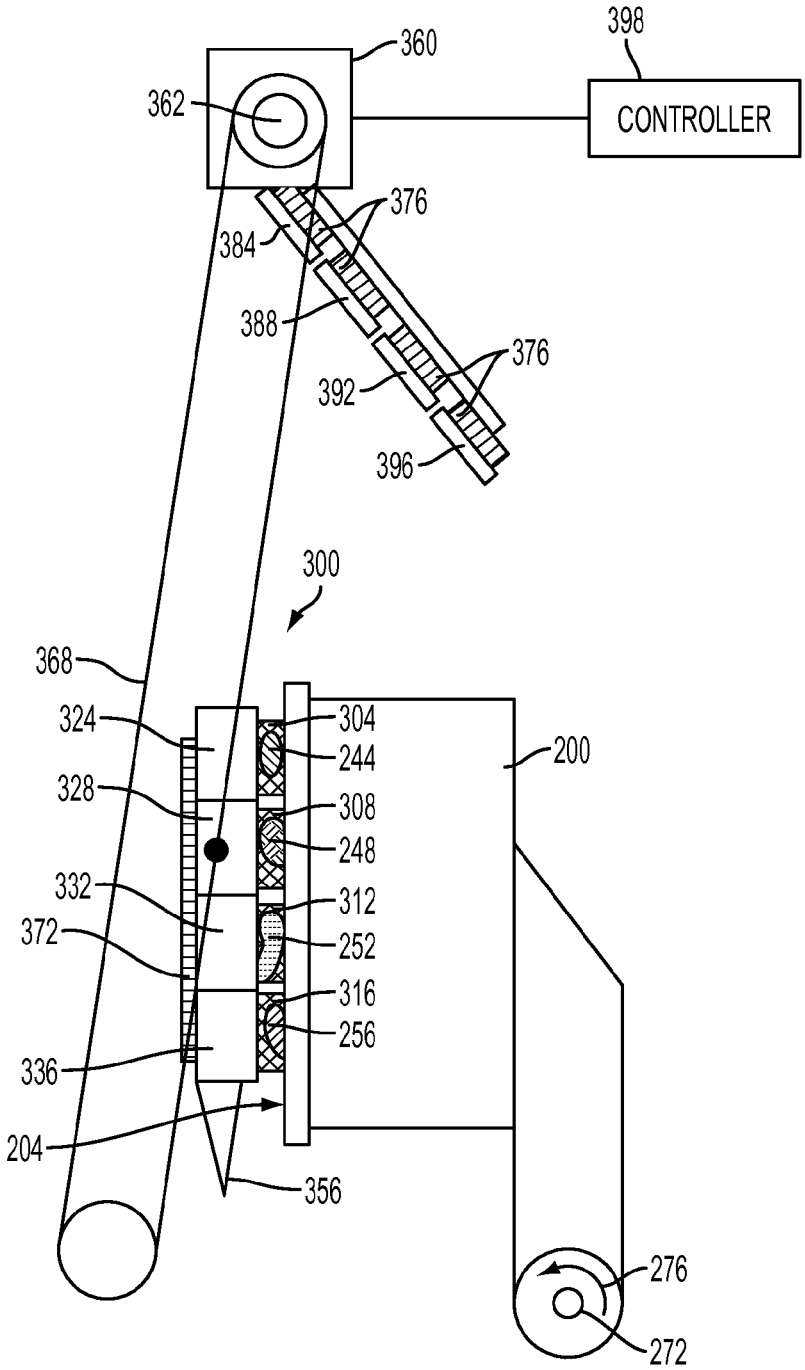
FIG. 5 is a side view of another ink collecting assembly absorbing ink from a printhead face.

FIG. 5 depicts another ink collecting assembly 300. The ink collecting assembly 300 includes an actuator 360, four support members 324, 328, 332, and 336, four porous pads 304, 308, 312, and 316, four ink channels 344, 348, 352, and 356 (FIG. 7), four heated plates 384, 388, 392, and 396 (FIG. 6), and a controller 398. The porous pads 304, 308, 312, and 316 are mounted to support members 324, 328, 332, and 336, respectively. As above, the porous pads 304-316 are formed of a material that enables the pads 304-316 to absorb ink from the printhead face 204 by capillary action. The support members 324-336 are operatively connected to a heater 372, which is configured to heat the support members 324-336 and porous pads 304-316 to a temperature suitable to liquefy phase change ink stored therein. The controller 398 is operatively connected to the actuator 360, and is configured similar to the controller described above with reference to FIG. 1-4.

The heated plates can be formed of any suitable material, such as anodized aluminum. In some embodiments, the heated plates are coated with a hydrophobic agent to prevent ink from adhering to the surface of the heated plates. The heated plates 384-396 are substantially the same size as the porous pads 304-316 to enable each heated plate 384-396 to contact only one porous pad 304-316. The heated plates are each heated by a heater 376, and can be mounted to the printhead or to any suitable structure in the printer. In other embodiments, the heated plates can be heated by a single heater. In one embodiment the heaters are an electrical resistive heater formed from nichrome wire, although in other embodiments other heaters are used.

The actuator 360 includes an output shaft 362 operatively connected to a belt 368. The actuator 360 is configured to rotate the output shaft 362, which moves the belt 368. The belt 368 is operatively connected to the support members 324-336, and moves the support members 324-336 in response to the output shaft 362 rotating. Although a belt drive is illustrated in the embodiment of FIG. 5-FIG. 7, any suitable drive mechanism can be used to move the ink collecting assembly 300, for example a gear drive, a friction drive, or a combination of drive components.

The actuator 360 moves the ink collecting assembly 300 to enable the porous pads 304-316 to contact the face 204 of the printhead 200. In the embodiment of FIG. 5, the printhead 200 is rotated about pivot point 272 by an actuator (not shown) or other suitable mechanism. The printhead 200 pivots in direction 276 (FIG. 5) to enable the pads 304-316 to contact the printhead face 204, and pivots in direction 280 (FIG. 6) to enable the ink collecting assembly 300 to pass by the printhead 200 without interference. As shown in FIG. 7, the printhead 200 includes four ink reservoirs 224, 228, 232, and 236, to enable the printhead 200 to accept each color of ink printed separately. In the embodiment of FIG. 5, the printhead 200 is configured with four groups of inkjet nozzles, each group being arranged substantially in a line and configured to eject a single color of ink.

In operation, one or more controllers operate a printer in which the ink collecting assembly 300 is installed periodically initiates a purge cycle in response to a user input, a predetermined number of print cycles, or during printer warm-up. The actuator 360 rotates, rotating the output shaft 362, which moves the belt 368 and the ink collecting assembly 300. The printhead 200 is configured to pivot in direction 276 about pivot point 272 to enable the porous pads 304-316 to contact the printhead face 204 and optionally to exert pressure on the porous pads 304-316 to compress the pads 304-316 into the printhead face 204. The actuator 360 rotates to position the ink collecting assembly to contact the printhead face 204 with the pads 304-316. The printhead 200 initiates a purge operation, pressurizing ink reservoirs within the printhead and causing ink to flow out of the inkjets in the printhead face 204. The porous pads 304-316 are in contact with the printhead face to absorb the purged ink as the ink flows out of the inkjets. Each pad 304-316 is aligned with one group of inkjets, and is substantially the same size as the inkjet group to enable each pad 304-316 to absorb a single color of ink from the printhead face during a purge operation. For example, cyan ink 244 flows from the upper inkjet group into the cyan pad 304, magenta ink 248 flows from the second inkjet group into the magenta pad 308, yellow ink 252 flows into the yellow pad 312 from the third inkjet group, and black ink 256 flows into the black pad 316 from the fourth inkjet group.

Figure 6:
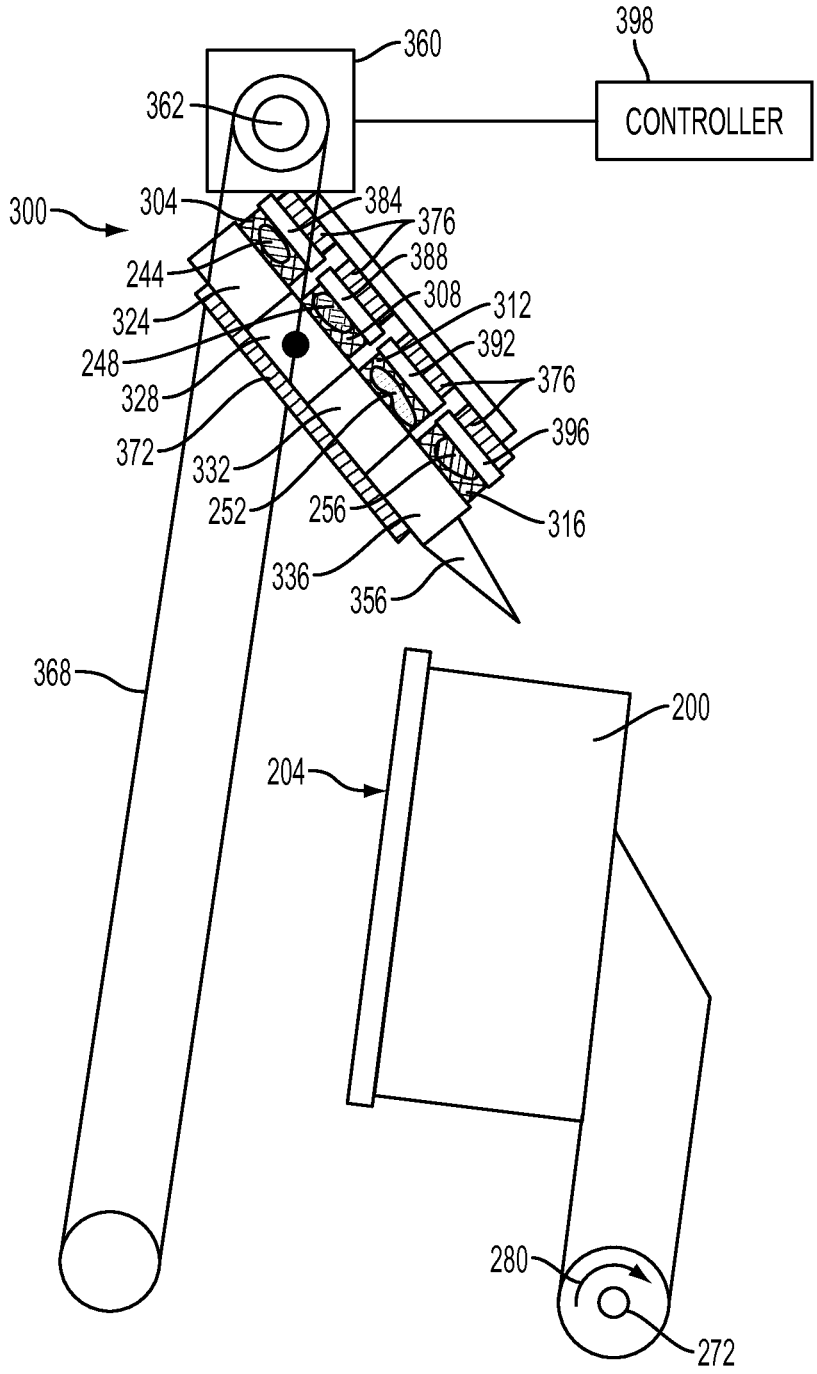
FIG. 6 is a side view of the ink collecting assembly of FIG. 5 engaged with a plurality of heated plates.
Figure 7:
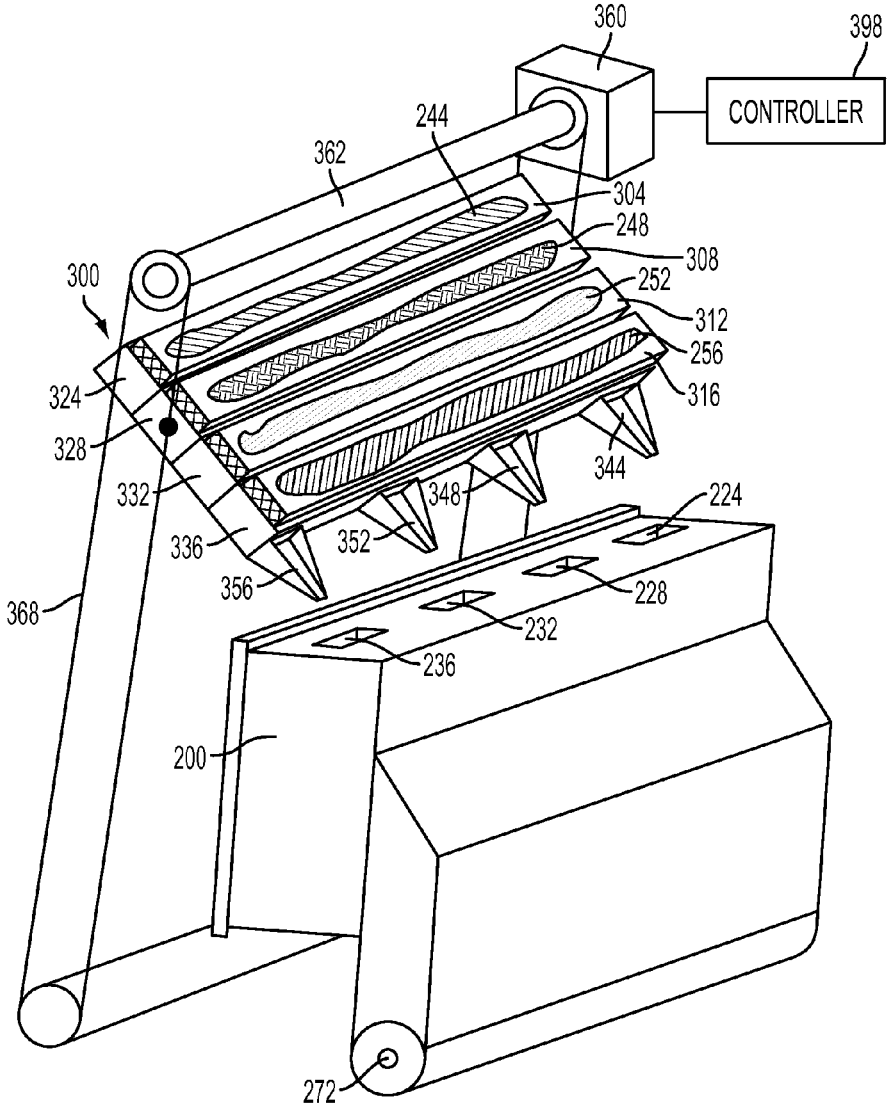
FIG. 7 is a perspective view of the ink collecting assembly of FIG. 5 with the heated plates removed for clarity.

Referring now to FIG. 6, after the pads 304-316 have absorbed the purged ink 244-256, a controller 398 activates the actuator 360 to rotate the output shaft 362 and move the belt 368. In response, the ink collecting assembly 300 moves upwardly along the belt path to a position above the printhead. The printhead is pivoted in direction 280 about pivot point 272 to enable the ink collecting assembly 300 to pass by the printhead 200 without contacting the printhead face 204 and to position the printhead 200 to receive the ink 244-256 from the pads 304-316. As the ink collecting assembly 300 reaches the heated plates, the actuator 360 continues to operate, pulling the ink collecting assembly 300 into contact with the heated plates 384-396. The ink collecting assembly 300 pivots in response to the continued operation of the actuator 360 to enable the porous pads 304, 308, 312, and 316 to contact heated plates 384, 388, 392, and 396, respectively. The heaters 376 on each of the heated plates 384-396 are activated to heat the porous pads and melt the phase change ink in the pads 304-316. As the porous pads 304, 308, 312, and 316 are pressed into heated plates 384, 388, 392, and 396, the ink 244, 248, 252, and 256 in the porous pads is forced into a chamber (not shown) in each of the support members 324, 328, 332, and 336, respectively.

FIG. 7 is a perspective view of the ink collecting assembly 300 and printhead 200 of FIG. 6 with the heated plates and heaters removed to better show the ink collecting assembly 300. Porous pads 304, 308, 312, and 316 are fluidly connected to chambers (not shown) within the support members 324, 328, 332, and 336 by one or more apertures (not shown) in the support members 324, 328, 332, and 336 behind the porous pads 304, 308, 312, and 316, respectively. The chambers in the support members 324, 328, 332, and 336 are fluidly connected to ink channels 344, 348, 352, and 356, respectively, through ink conduits within the support members. Thus, as the porous pads 304-316 are pressed against the heated plates 384-396 the ink in the pads is released into the chambers within the support members 324-336. Heater 372 keeps the ink within the chambers in a liquid form as the ink is directed to the ink channels 344-356. Black ink is directed from support member 336 to channel 356, where the black ink flows into the black ink reservoir 236 in the printhead 200. Cyan, yellow, and magenta inks are directed from support members 324, 328, and 332, respectively, into channels 344, 348, and 352, where the ink flows into cyan 224, magenta 228, and yellow 232 ink reservoirs, respectively. Once the ink is directed into the appropriate reservoir, the ink is mixed with the ink of the corresponding color in the printhead 200 for ejection by the inkjet nozzles onto an image receiving surface or in another purge cycle.

Figure 8:
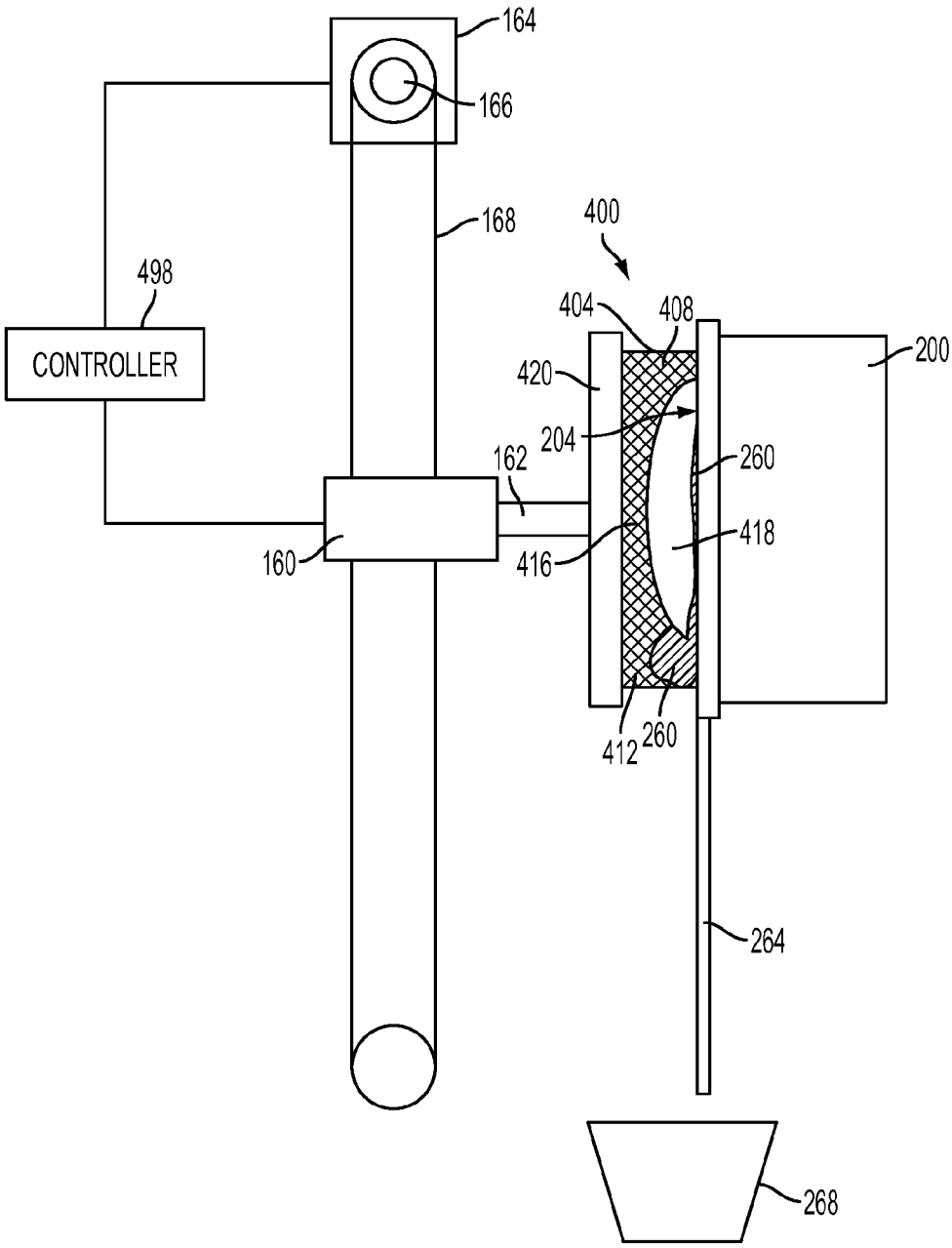
FIG. 8 is a side view of another embodiment of an ink collecting assembly engaged with a printhead during a purge cycle.

FIG. 8 depicts another ink collecting assembly 400. The ink collecting assembly 400 includes a horizontal actuator 160, a vertical actuator 164, a support member 420, a porous pad 404, and a controller 498. The horizontal 160 and vertical 164 actuators, including output shafts 162 and 166 and belt 168, operate in the same manner as the actuators described above with reference to FIG. 1-4 to move the support member 420 and porous pad 404. The porous pad 404 is affixed to the support member 420, which is attached to an output shaft 162 of the horizontal actuator 160 to enable the support member 420 and porous pad 404 to move in response to the output shaft 162 moving. The controller 498 is operatively connected to the actuators 160 and 164 and is configured similar to the controller described above with reference to FIG. 1-4.

The porous pad 404 includes an upper portion 408, a lower portion 412, and a recessed portion 416. The upper portion 408 and lower portion 412 are separated by the recessed portion 416, which defines a void 418 between the recessed portion 416 and the printhead face 204 when the top 408 and bottom 412 portions are in contact with the printhead face 204.

In operation, the controller 498 operates the vertical actuator 164 to move the ink collecting assembly 400 opposite the printhead 200 in response to the printhead 200 initiating a purge operation. The controller 498 operates the horizontal actuator 160 to push the support member 420 and porous pad 404 into contact with the printhead face 204. The porous pad 404 can optionally be compressed into the printhead face 204 to enable the pad 404 to absorb ink deeper into the pad 404. While the porous pad 404 is in contact with the printhead face 204, ink begins purging through the inkjet nozzles. Ink pours from the nozzles and flows down the printhead face 204 within the void 418 between the upper 408 and lower 412 portions of the porous pad 404. The ink flows downwardly until the ink 260 is absorbed by the lower portion 412 of the porous pad 404.

After the purge is complete, residual ink may remain on the printhead face 204. To remove the residual ink, the controller 498 operates the vertical actuator 164 to move the support member 420 and porous pad 404 downwardly while the pad 404 remains in contact with the printhead face 204. As the porous pad 404 moves downwardly, the upper portion 408 of the pad 404 wipes the printhead face 204, absorbing any ink remaining on the face 204. The vertical actuator 164 continues moving the support member 420 and porous pad 404 downwardly until the upper portion 408 of the porous pad contacts the drip bib 264 in the position shown in FIG. 9.

Figure 9:
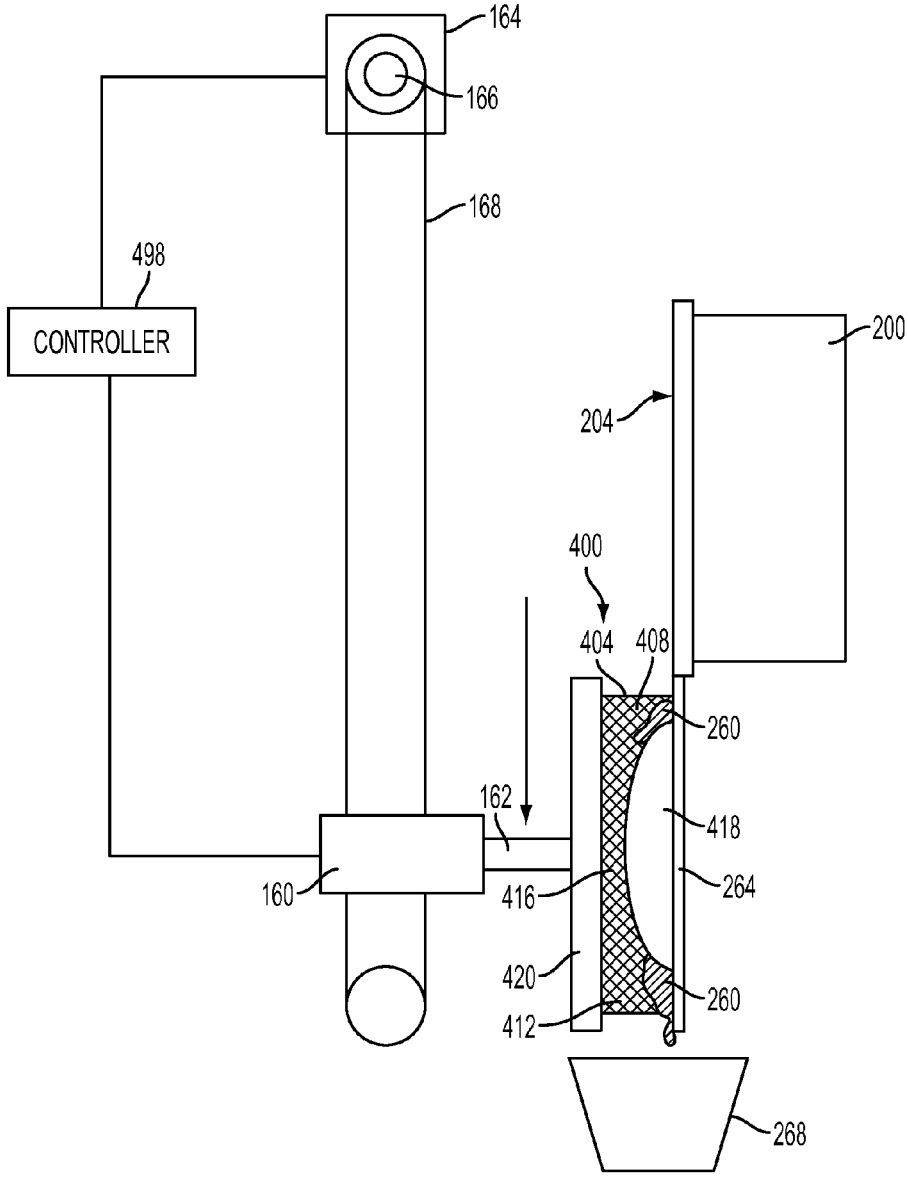
FIG. 9 is a side view of the ink collecting assembly of FIG. 8 engaged with a drip bib.

Once the porous pad is in the position of FIG. 9, the controller 498 operates the horizontal actuator 160 to compress the porous pad 404 into the drip bib 264. In response, the ink 260 in the lower portion 412 of the pad 404 is released from the pad, and the ink 260 flows down the drip bib 264 and into the ink receptacle 268. The ink 260 in the upper portion 408 of the pad 404 flows down the drip bib 264 and soaks into the lower portion 412 of the pad 404. The horizontal actuator 160 is then operated to disengage the porous pad 404 from the drip bib, and then to compress the pad 404 against the drip bib again to release additional ink from the pad 404. The controller 498 can be configured to operate the horizontal actuator 160 to repeatedly disengage and reengage the pad 404 with the drib bib 264 a predetermined number of times to release a greater quantity of the ink stored in the pad.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A device for cleaning a printhead comprising:

a porous pad;

a support member to which the porous pad is fixedly attached;

a heated member; and a first actuator operatively connected to the support member and configured to move the support member to a first position where the porous pad is proximate to a face of a printhead to enable the porous pad to absorb melted phase change ink from the face of the printhead by capillary action and to a second position where the porous pad is pressed against the heated member to enable the heated member to release ink from the porous pad to enable the released ink to be directed to an ink receptacle.

2. The device of claim 1, the ink receptacle further comprising:

an ink reservoir in the printhead, the ink reservoir being fluidly connected to a plurality of inkjets in the printhead to supply phase change ink to the plurality of inkjets; and the heated member being positioned at a location that enables the ink released by the heated member to flow into the ink reservoir.

3. The device of claim 1, the heated member further comprising:

a drip bib mounted to a portion of the printhead face at a position that enables ink released by the drip bib to flow into the ink receptacle as the porous pad is compressed against the drip bib.

4. The device of claim 1 further comprising:

a second actuator operatively connected to the support member and configured to compress the porous pad into the heated member.

5. The device of claim 1 further comprising:

a plurality of porous pads fixedly attached to the support member, a number of porous pads in the plurality of porous pads being equal to a number of different colors of ink printed by the printhead; and the first actuator being configured to position each porous pad on the face of the printhead to enable each porous pad to absorb ink of only one color that is different than a color of ink absorbed by the other porous pads in the plurality of porous pads.

6. The device of claim 5 further comprising:

a plurality of heated members; and the first actuator being configured to press each porous pad in the plurality of porous pads against a different heated member in the plurality of heated members to enable each heated member in the plurality of heated members to release ink from only one porous pad in the plurality of porous pads and to enable the released ink to be directed into an ink reservoir in the printhead that corresponds to the one color of ink absorbed by the one porous pad pressed against the heated member.

7. The device of claim 1, the first actuator being further configured to move the porous pad in a cross process direction to wipe the printhead face.

8. The device of claim 7, the porous pad further comprising:

a first portion configured to contact the printhead face and wipe the printhead face as the porous pad is moved in the cross process direction;

a second portion configured to contact the printhead face and absorb phase change ink from the printhead face; and a third portion between the first and second portions, the third portion being recessed from the first and second portions to separate the third portion from the printhead face while either the first portion or the second portion contacts the printhead face.

9. The device of claim 1 further comprising:

a heater operatively connected to the support member to heat the porous pad to a predetermined temperature to facilitate absorption of melted ink into the porous pad.

10. A method of removing liquid phase change ink from a printhead comprising:

moving a porous pad to a first position to absorb melted phase change ink from a face of a printhead by capillary action, the porous pad being fixedly attached to a support member that is operatively connected to a first actuator to enable the first actuator to move the porous pad to the first position; and moving the porous pad to a second position, where the porous pad is pressed against a heated member to enable the heated member to release ink from the porous pad and to enable the released ink to be directed into an ink receptacle.

11. The method of claim 10 further comprising:

positioning the heated member at a location that enables the ink released by the heated member to flow into an ink reservoir that is fluidly connected to a plurality of inkjets in the printhead to supply phase change ink to the plurality of inkjets; and collecting the phase change ink released by the heated member in the ink reservoir.

12. The method of claim 10, the heated member further comprising:

a drip bib mounted to a portion of the printhead face at a position that enables ink released by the drip bib to flow into the ink receptacle as the porous pad is compressed against the drip bib.

13. The method of claim 10 further comprising:

compressing the porous pad into the heated member with a second actuator, which is operatively connected to the support member.

14. The method of claim 10 further comprising:

positioning each porous pad in a plurality of porous pads on the face of the printhead to enable each porous pad to absorb ink of only one color that is different than a color of ink absorbed by the other porous pads in the plurality of porous pads; and the plurality of porous pads being fixedly attached to the support member, a number of porous pads being equal to a number of different colors of ink printed by the printhead.

15. The method of claim 14 further comprising:

pressing each porous pad in the plurality of porous pads against a different heated member in the plurality of heated members with the first actuator to enable each heated member in the plurality of heated members to release ink from only one porous pad in the plurality of porous pads; and directing the released ink into an ink reservoir in the printhead that corresponds to the one color of ink absorbed by the one porous pad pressed against the heated member.

16. The method of claim 10 further comprising:

moving the porous pad in a cross process direction with the first actuator to wipe the printhead face.

17. The method of claim 16 further comprising:

wiping the printhead face with a first portion of the porous pad as the porous pad is moved in the cross-process direction;

absorbing phase change ink from the printhead face with a second portion of the porous pad; and the first and second portions being separated by a third portion of the porous pad, the third portion being recessed from the first and second portions.

18. The method of claim 10 further comprising:

moving the support member and porous pad with the first actuator to enable the porous pad to contact the printhead face;

ejecting ink from a plurality of inkjets in the printhead while the porous pad is in contact with the printhead face; and absorbing the ink ejected from the plurality of inkjets with the porous member.

19. The method of claim 10 further comprising:

heating the porous pad to a predetermined temperature with a heater operatively connected to the support member.

* * * * *